US005320339A

United States Patent [19]

Thomas et al.

[11] Patent Number: 5,320,339

[45] Date of Patent: Jun. 14, 1994

[54] VARIABLE PRESSURE SYSTEM FOR CONTROLLING PRESSURE EXERTED ON A TRANSPORT BELT

[75] Inventors: Kendolph A. Thomas; William D. Milillo, both of Ontario; Paula E. Reid, Rochester; Michele D. Taber, Rochester; John R. Falvo, Rochester; James F. Smoak, Webster; Charles D. Rizzolo, Irondequoit, all of N.Y.

[73] Assignee: Xerox Corporation, Stamford, Conn.

[21] Appl. No.: 328

[22] Filed: Jan. 4, 1993

[51] Int. Cl.[5] ..... B65H 5/00

[52] U.S. Cl. ..... 271/225; 271/275; 271/902

[58] Field of Search ..... 271/225, 275, 902, 3.1, 271/184

[56] References Cited

U.S. PATENT DOCUMENTS

| | | | |
|---|---|---|---|
| 3,941,376 | 3/1976 | Liechty et al. | 271/275 |
| 4,231,562 | 11/1980 | Hori | 271/225 X |
| 4,353,541 | 10/1982 | Parzygnat | 271/275 |
| 4,469,319 | 9/1984 | Robb et al. | 271/3.1 |
| 4,534,551 | 8/1985 | Jones | 271/275 |
| 4,579,327 | 4/1986 | Furuichi | 271/225 X |
| 4,627,709 | 12/1986 | Kitajima | 355/14 |
| 4,884,794 | 12/1989 | Dinatale et al. | 271/3 |
| 5,204,724 | 4/1993 | Nakabayashi et al. | 271/275 X |

FOREIGN PATENT DOCUMENTS

| | | | |
|---|---|---|---|
| 2040887 | 9/1980 | United Kingdom | 271/275 |

*Primary Examiner*—Robert P. Olszewski
*Assistant Examiner*—Boris Milef

[57] ABSTRACT

A reciprocating document handler for transporting documents comprising a belt transport supported for transporting sheets in a first and a second, opposite direction. The device further includes apparatus for allowing documents moving in the first and second directions, respectively, at an exchange area on the belt to slide over one another substantially freely. The device includes a pressure member to urge the belt into engaging with transported documents and a mechanism for reducing the bearing of a pressure member proximate the exchange area to promote the substantially free sliding engagement of the documents transported in opposite directions.

2 Claims, 4 Drawing Sheets

VARIABLE PRESSURE SYSTEM FOR CONTROLLING PRESSURE EXERTED ON A TRANSPORT BELT

The present invention relates to a sheet handling system for transporting sheets to and from a processing station, and, more particularly, relates to a reciprocating document handling system which exchanges documents by passing one over another as documents are transported to and from an image input terminal.

U.S. Pat. Nos. 4,884,794 and 4,353,541 are hereby incorporated herein by reference thereto.

BACKGROUND OF THE INVENTION

Sheet handling systems, including in particular document handling systems for transporting members bearing indicia to and from imaging stations, are well known. Generally, document handlers have a defined path into which documents held in a tray or input area are drawn and transported to an image processing station, for example, an image input terminal. Document handlers, also generally, provide a path through which the documents are withdrawn from the image processing station.

Reciprocating document handling systems of the type to which this invention relates are those in which, in at least some instances, documents are directed in the opposite direction from others of those transported in the document handling system. That is, for example, documents entering a processing station pass over or under, depending on the construction of the defined paths, the documents exiting the processing station.

In the past, devices of this type have been usually operated at sufficiently slow speed (e.g., approximately 30 documents per minute) so that little or no overlap of the documents entering and exiting the processing station occurred. However, as seemingly the case with all devices, there exists the need and desire to increase the speed of these document handlers. One approach is to simply increase the speed of operation by having a high throughput rate e.g., of 60 documents per minute. However, such an increase in speed would require document exchange times on the order of 400 milliseconds or less. Further, due to the reciprocation of the belt, the acceleration and deceleration of the belt are critical constraints. Thus, there exists a need to permit greater overlap of the documents in such reciprocating document handlers without the attendant problems of smearing, stubbing, improper registration, jamming, and the like so that the throughput rate of document increase is not only a function of increasing the speed of document travel.

The following patents may be of relevance to the present invention:

U.S. Pat. No. 4,627,709
Patentee: Kitajima et al.
Issued: Dec. 9, 1986
U.S. Pat. No. 4,469,319
Patentee: Robb et al.
Issued: Sep. 4, 1984
U.S. Pat. No. 4,884,794
Patentee: Dinatale et al.
Issued: Dec. 5, 1989
U.S. Pat. No. 4,353,541
Patentee: Parzygnat
Issued: Oct. 12, 1982

U.S. Pat. No. 4,627,709 discloses an automatic document handler for feeding documents to an image processing station to record the information on the document. The handler includes a belt, which is operable in two directions and which is urged into position by backup rollers. The belt is provided for transporting the documents onto and off of a platen. Apparatus is also provided for inverting the transported documents so that the information on both sides of the document may be recorded.

U.S. Pat. No. 4,469,319 discloses a document handler having rollers which engage a document to transport across a platen. The rollers are actuable to lift them so that the loading force on documents on the surface of the platen is reduced.

U.S. Pat. No. 4,884,794 discloses a reciprocating, recirculating document handler for feeding documents to an image processing station to record the information on the document. The handler includes a belt, which is operable in two directions and which is urged into position by backup rollers. The belt is provided for transporting the documents onto and off of a platen. Apparatus is also provided for inverting the transported documents so that the information on both sides of the document may be recorded and for permitting recirculation of the documents in a simplex and duplex manner.

U.S. Pat. No. 4,353,541 discloses a copier document handling apparatus for feeding documents to and from a registration position at an imaging station of a copier with reversible direction of the belt feed at the station. A pressure roller is disposed above a surface of the belt to urge the belt into closer engagement with the surface. The pressure roller is actuated by the action of the belt so that when feeding document the registered position at the imaging station the pressure of the roller on the belt is decreased relative to the higher pressure exerted on the belt as a document is urged from the station.

In accordance with one aspect of the present invention, there is provided a document handling apparatus for transporting documents to and from a processing station, which comprises means for moving a first document to the processing station and a second document from the processing station with a portion of the first document being in sliding contact with a portion of the second document and the first document moving in a direction opposed to the direction of movement of the second document. The moving means of this apparatus can comprise a belt transport adapted to move in a first direction to move the first document to the processing station and in a second direction opposed to the first direction, to move the second document from the processing station. Further, the process station may comprise a platen, and the belt transport may comprise a belt positioned adjacent the platen and also comprise means for urging at least a portion of said belt toward the platen with the documents being adapted to be interposed between the belt and the platen.

The apparatus according to this aspect of the invention can further include comprises a movable pressure member adapted to move in a first direction to urge the belt toward the platen and in a second direction, opposed from the first direction, to reduce the force being applied on the belt. The urging means according to this aspect of the invention may comprise a stationary pressure member adapted to press the belt against the platen defining a nip therebetween with the document entering the processing station and exiting the processing station at a common marginal region of the nip. In further accordance with this aspect of the invention, the pressure member may also comprise a roller and means for moving the roller in the first direction to increase the force applied on the belt and in the second direction to decrease the force applied on the belt, or the pressure member may comprise a gravity biased roller and an actuating device for lifting the roller away from the belt to reduce the force being applied on the belt. According to this aspect of the invention, documents transported in the first direction engage the belt and documents transported in the second direction exit the belt, such that the documents slide substantially freely relative to one another. The invention may also include positioning the urging means proximate a marginal region of the belt with the documents being adapted to be moved toward the marginal region of the belt and away from the marginal region of the belt.

Pursuant to another aspect of the present invention, there is provided a method for exchanging documents exiting and entering a transport belt at an exchange area in a first direction and a second opposite direction, respectively. This method comprises the steps of: rotating a transport belt in the first direction; urging the leading edge of a document exiting the transport belt to continue in the first direction; directing a second document to the belt in a second direction; reversing the direction of the transport belt to engage and transport the second document in the second direction; engaging sides of the first and the second documents at the exchange area; and relieving the bearing pressure of the transport belt proximate the exchange area to promote the free sliding of the engaged sides of the first and the second documents at the exchange area. The method may also include the step of: engaging the first document in a driving roll nip as part of the urging step; actuating a pressure roll for bearing on the belt transport from a position adjacent the belt transport to a position away from the belt transport as part of the relieving step; and returning the pressure member to its position adjacent the belt transport after said engaging step.

Pursuant to yet another aspect of the invention, a reciprocating document handler for transporting documents to and from a processing station comprises a belt transport for transporting documents entering the processing station in a first direction and exiting the processing station in a second direction, opposed to said first direction, means for reducing pressure exerted on documents entering and exiting the processing station, and means for directing one document onto the belt transport substantially concurrently with another document leaving the belt transport. The document handler of this aspect of the invention may further comprise means for driving the other document in the second direction as the one document is directed onto said belt transport, and the reducing means of the document handler may include an actuable pressure member supported proximate an area of the belt transport where the transported documents enter the process station and the transported documents exit the process station.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION

Figure 5:
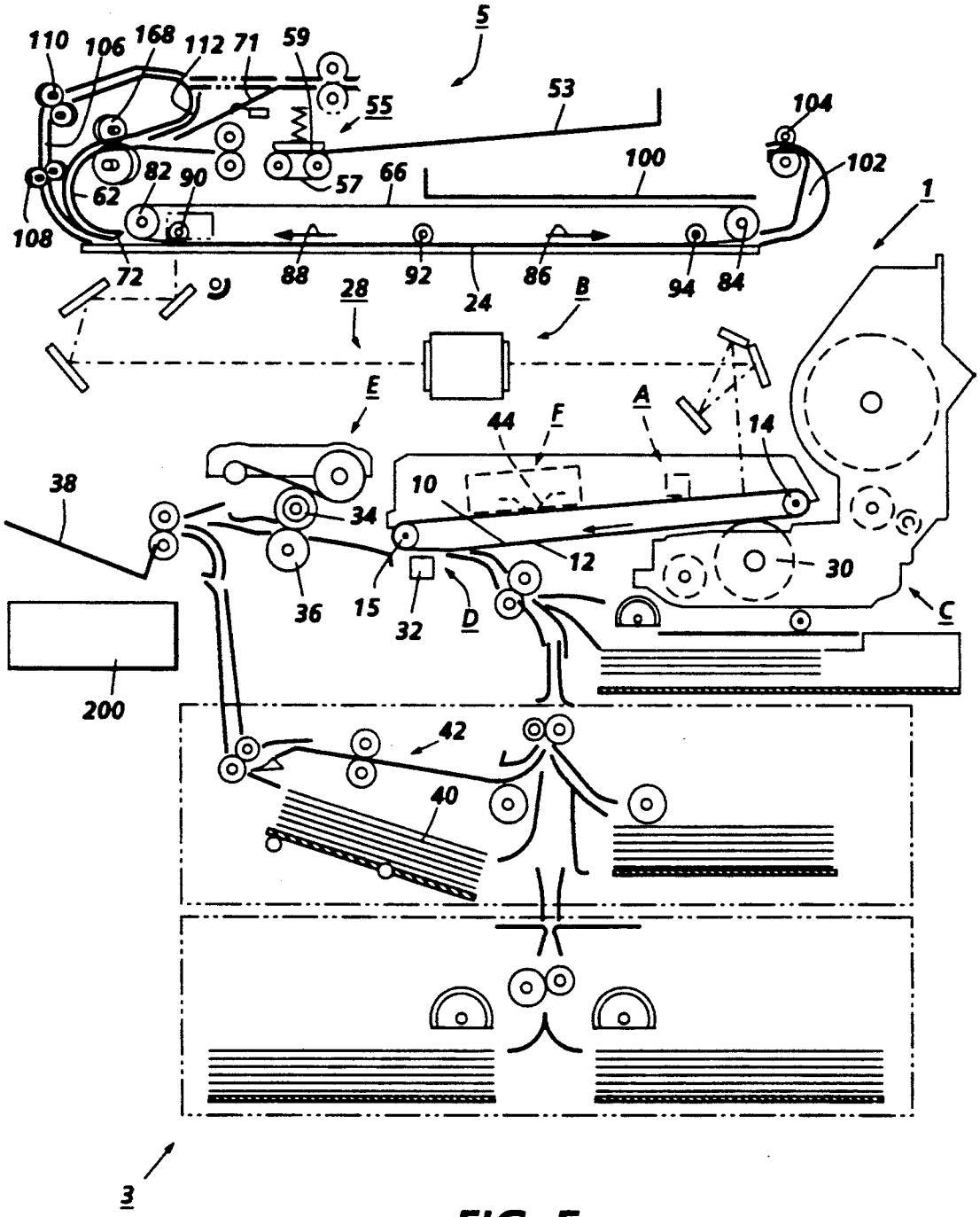
FIG. 5 is a schematic elevational view depicting an illustrative electrophotographic printing machine incorporating the document handler system of the present invention.

FIG. 5 schematically depicts an illustrative electrophotographic printing machine of the type in which the present invention may be employed. Specifically, the printing machine 1 of FIG. 5 has both a copy sheet handling system 3 and a document handling system 5 for transporting sheets of material such as paper, Mylar and the like, to and from processing stations of the machine 1. The machine 1, has conventional imaging processing stations associated therewith, including a charging station A, an imaging/exposing station B, a development station C, a transfer station D, a fusing station E, and a cleaning station F. It will be understood that a conventional finishing station (not shown) could easily be included in the machine. The machine 1 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 1 can be briefly described as follows:

The photoconductive belt 10 is charged at the charging station A by a corona generating device 20. The charged portion of the belt is then transported by action the drive roller 14 to the imaging/exposing station B where a latent image is formed on the belt 10 corresponding to the image on a document positioned on a platen 24 via the light lens imaging system 28 of the imaging/exposing station B. It will also be understood that the light lens imaging system can easily be changed to an input/output scanning terminal or an output scanning terminal driven by a data input signal to likewise image the belt 10.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy handling system 3. In this case, a corona generating device 32 is provided to attract the toner image from the photoconductive belt 10 to the copy sheet substrate. The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to an output tray 38 or along a selectable duplex path (i.e., tray 40 and path 42 in the case of the illustrative printing machine of FIG. 5) for duplexing. The portion of the belt 10 which bore the developed image is then advanced to the cleaning station F where residual toner and charge on the belt a-c removed by a blade edge 44 and a discharge lamp (not shown). The cycle is then repeated.

The invention will now be discussed in greater detail with respect to FIG. 1, which represents a document handling system 5 for feeding documents from an input tray 53 to an imaging platen 24 of the type used in electrophotographic printing machines, as well as image input scanning devices. In this instance documents are fed sequentially from a stack of document sheets (not shown) disposed in the tray 53 by the retard feed device 55 which includes the driven belt 57 and the pressure member 59 (not shown) so that individual documents are fed from the bottom of the stack.

Documents fed by the retard feed device 55 are directed along an input path 62 toward a transport belt 66. A set of cross rollers 68 assist the transport of documents along path 62 and also urge the registration of the fed documents along a lateral registration edge (not shown). A gate 72 which is biased to the closed position is positioned at the base of the path 62 and the entrance to belt transport 66. The gate 72 is of the type which permits the relatively uninhibited passage of documents from the path 62 to the belt 66 but which resists the passage of documents from the belt 66 to the path 62, as more fully explained below. In this case, documents may also be inserted in the document path 62 and transported to the belt transport 66 via cross-rollers 68 by a bypass shelf 71.

The transport belt 66 is entrained about a tension roller 82 and a drive roller 84. The drive roller is driven by a drive means (not shown) suitably connected so that the belt may be driven in the forward direction indicated by arrow 86 and in the reverse direction indicated by arrow 88. Thus, as a document enters the imaging area, the belt transport 66 is driven in the forward direction indicated by the arrow 86 to urge the document, onto the platen 24. Backup or pressure rollers 90, 92, and 94 are provided to urge the belt transport into closer proximity with the platen to assist transport of the document.

Ordinarily, during processing the belt 66 is usually stopped, the belt 66 is restarted in the direction of arrow 86 to urge the document toward the output tray 100 along the output path 102 via exit nip rollers 104. However, in the document handling system depicted herein, often it is necessary to invert the document for return to the platen 24. In this instance, the depicted document handling system 5 is provided with an inversion path 106 so that documents directed off the platen 24 by the reverse rotation of the belt transport 66 in the direction of arrow 88 pass to the path 106. As previously noted, the gate 72 is positioned to oppose entry of such exiting documents into the path 62. The inversion path 106 is provided with a roller set 108 and a roller set 110 for urging documents along the path through a J-shaped baffle 112 to the cross-rollers 68 so that the document, now inverted, is directed to the belt transport 66 and the platen 24. As shown by phantom lines, in FIG. 1 a reciprocating, recirculating, and inverting document handler of the type described in U.S. Pat. No. 4,884,794, incorporated herein by reference herein, can be used with the present invention. In that case, by providing a selectable gate to divert sheets back to the tray 53, the output tray 100, output path 102 and exit nip rollers 104 could be eliminated. As will be understood, by including an inverter along recirculation path 106 of FIG. 1, such as described also described in U.S. Pat. No. 4,884,794, documents could be recirculated without inversion to the tray 53 for pre-collated imaging of sets of simplex documents.

In operation, it will be recognized that, depending on the speed of operation and the timing of documents passing in path 62 and those directed to the recirculation path 106 of the above-described document handling system 5 documents exiting the belt transport 66 can meet and/or overlap documents entering the belt transport 66 from path 62. In order to facilitate this overlap and to thereby increase the operating speed of such devices, this invention provides means for actuating the pressure roll 90 so that documents traveling in opposite directions onto and off of the belt transport tend to slide over one another.

Figures 1, 1A:
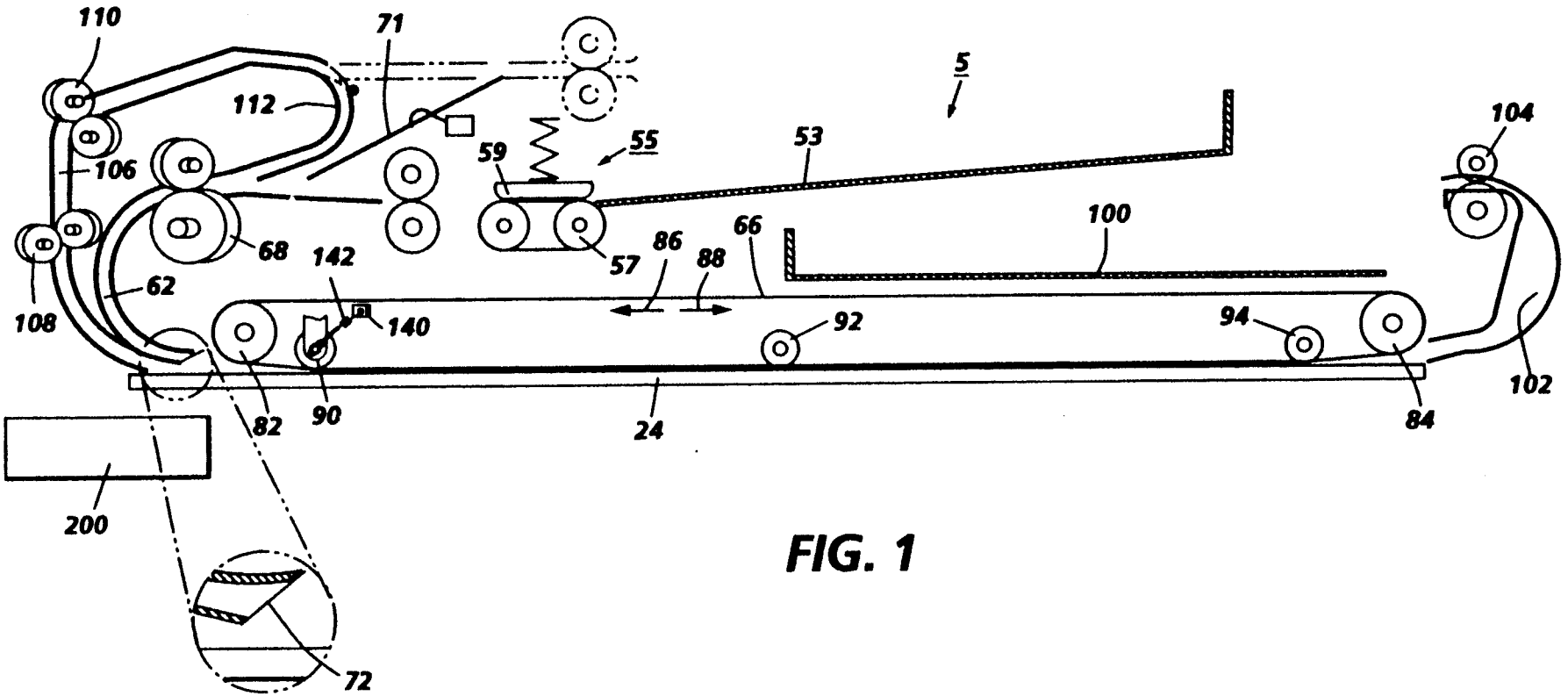
FIG. 1 is an enlarged elevational view of a document handler system incorporating the features of the present invention therein.
FIG. 1A is an enlarged, fragmentary elevational view, partial in section, of a portion of the document handler system of FIG. 1.
Figure 2A:
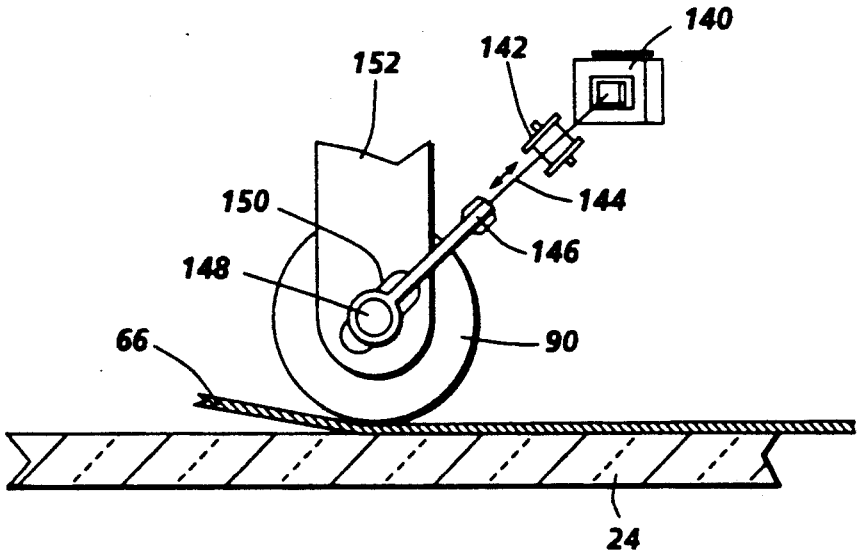
FIG. 2A is an enlarged elevational view of a portion of the document handler system of FIG. 1.
Figure 2B:
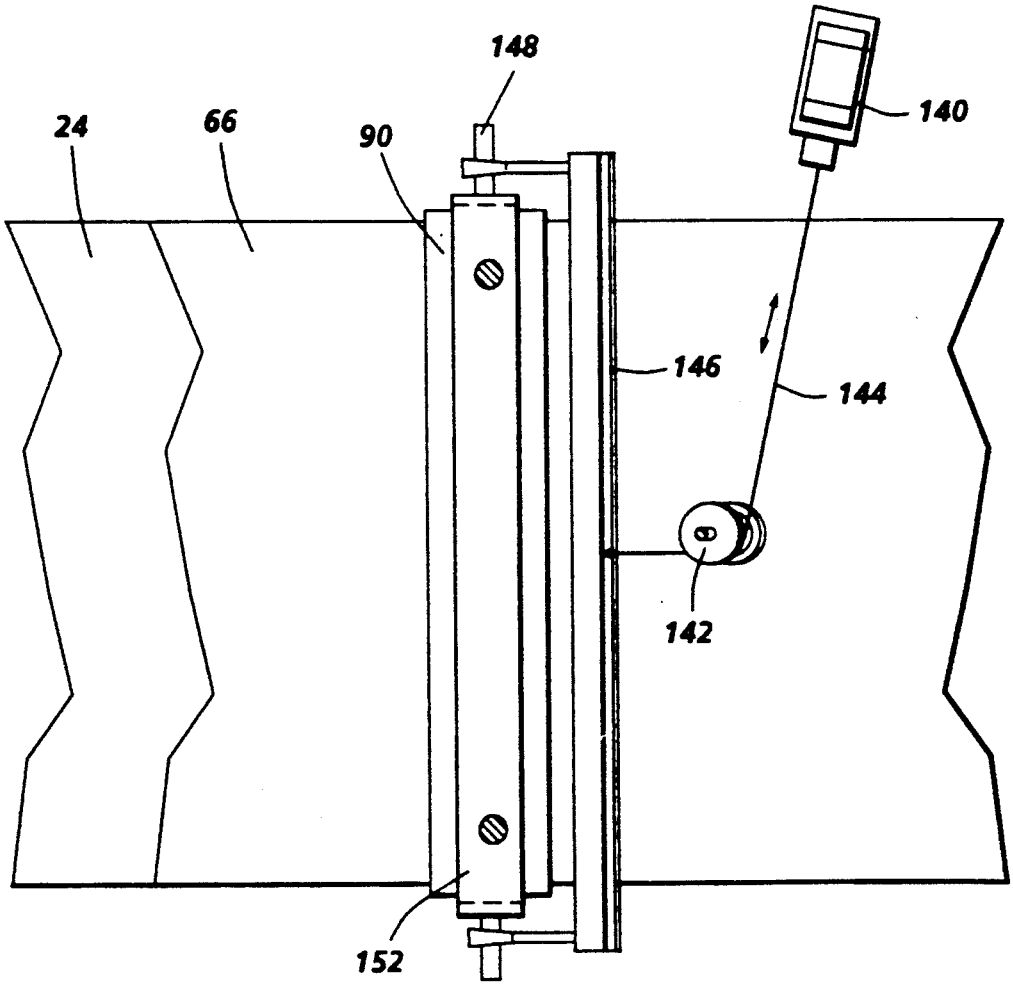
FIG. 2B is plan view of the portion of the document handler system of FIG. 2A.

Reference will now be made to FIGS. 1, 2A and 2B to explain and illustrate the apparatus for actuation of the pressure roll. As seen in FIGS. 2A and 2B, the apparatus includes a solenoid 140, a cam and a pulley arrangement 142, and a cable 144. The cable 144 connects a yoke 146 secured to the ends of axle 148 on which the gravity roller 90 freely rotates with the solenoid 140 to permit the raising and lowering of the roller 90. As seen most clearly in FIG. 2A, the roller 90 rotates on the axle 148, which resides in apertures 150 of support brackets 152. Thus, actuation of the solenoid to raise the roller 90 causes the axle 148 to move upwardly in the aperture 150. It will be understood that the reciprocal actuation of the solenoid permits the roller 90 to return to its normal position, but inhibits the yoke from interfering with the operation of the device. It will be also understood that other manners of actuation are possible and contemplated hereby.

In operation, the documents are timed by a controller 200 via appropriate sense and control signal so that a document transported off the platen by rotation of the belt 66 in direction 88 has been engaged by the rollers 108 prior to the following events: the stoppage and reversal of direction of the belt transport 66; the actuation of the roller 90 to an unloaded position, and the presentation of another document to the platen 24. At this time, a document would be directed toward the belt transport by the cross-rollers 68, as the rollers 108 drive the exiting document, the solenoid 140 is actuated to lift the pressure roll 90, and the belt transport 66 is actuated in the direction of arrow 86 to urge the entering document onto the platen 24. The exiting document would thus loose static contact with the belt and would instead be sliding under the entering document and any portion of the belt remaining positioned thereover. It will be further understood, that the closer the rollers 108 can be position to the margin or entrance/exit area of the belt 66 along the path 106, the earlier a document can be fed to the belt 66 for entrance to the imaging area, and thus, the faster the potential overall speed or throughput of a document handler made in accordance with this invention.

It will be appreciated that the present invention can be employed with a recirculating document handler of the type disclosed and described in U.S. Pat. No. 4,884,794. Thus, the present invention provides a relatively low cost reciprocating document handlers capable of greater throughput of documents, as well as recirculation of documents for immediate duplexing and recirculation of documents for pre-collated set imaging of simplex and duplex documents. In this manner, the sliding engagement of the documents traveling in opposite directions is enabled without detrimental smearing, stubbing and the like is enabled.

As will be also understood, the control signals for the document handler operation are provided by controller 200 which is preferably a conventional microprocessor system. It is contemplated that the controller controls all machine steps and functions described herein, as well as that of any and/or all apparatus and devices associated with the document handler, such as, for example, an electrophotographic printing machine.

Figure 3:
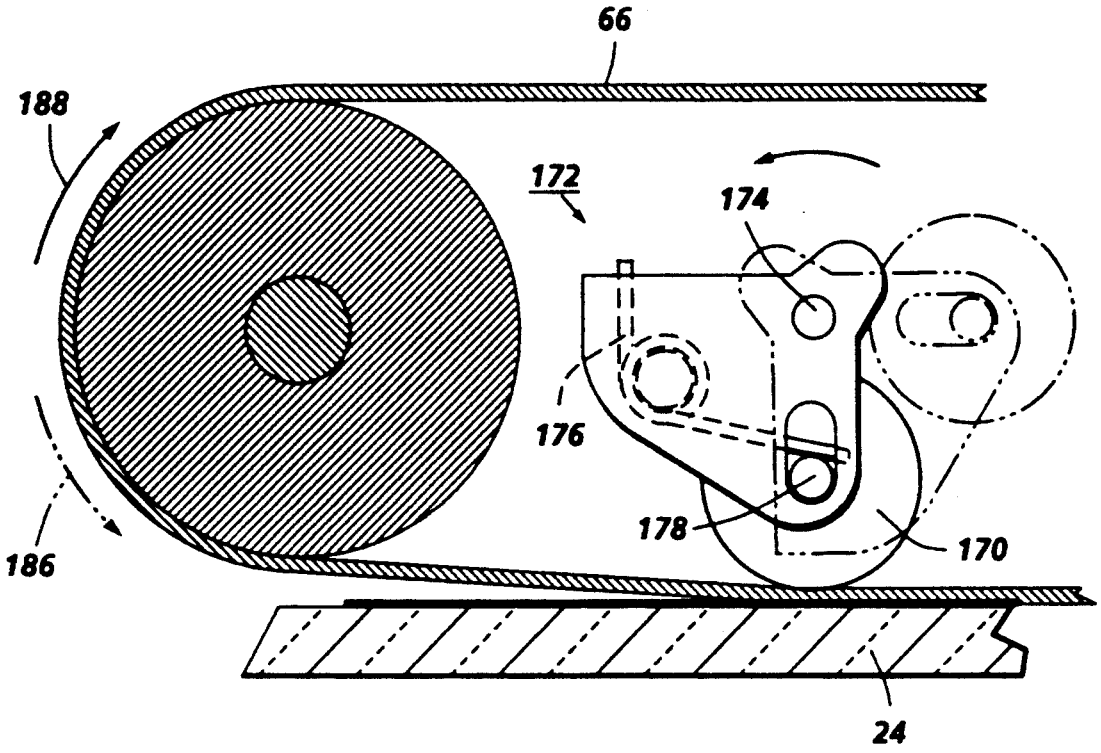
FIG. 3 is a perspective view of a portion of the document handler incorporating the features of another embodiment of the present invention.
Figure 4:
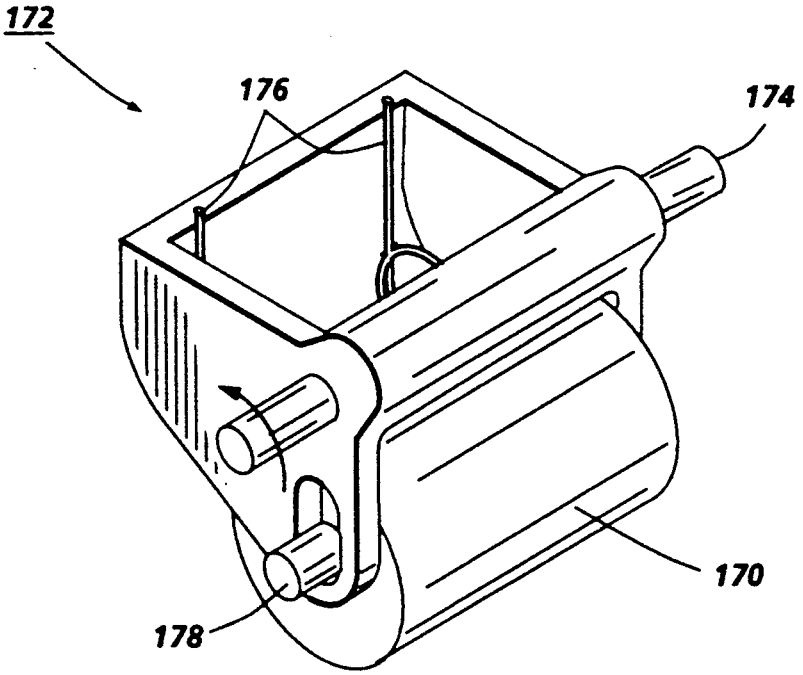
FIG. 4 is an enlarged, fragmentary, sectional, elevational view of a portion of the embodiment of FIG. 3.

With reference now to FIGS. 3 and 4, another embodiment of the present invention is depicted. Pressure roller 170 is mounted in bracket assembly 172. The bracket assembly is fixed on a rotatable member 174. In this case, the pressure exerted by the roller 170, is both a function of gravity and spring bias force supplied by spring members 176 through axles 178 on which the roller 170 rotates. Thus, rotation of the member 174 by a motor (not shown) suitably connected, will actuate the roller 170 between the position bearing on the belt transport 66 and the unloaded position shown in phantom lines of FIG. 3. In all other respects, this embodiment functions and operates as the embodiment of FIG. 1.

In recapitulation, a reciprocating document handling system which permits the transport of documents onto and off of a platen has been described. The document handler has a transport belt for transporting sheets onto and off of the platen which is operable bidirectionally. The pressure roll for urging the belt into engagement with the platen is selectively actuable to permit the documents which are moving in opposed directions to tend to slide relatively freely over one another.

It is, therefore, apparent that there has been provided in accordance with the present invention, a reciprocating document handler that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A document handling apparatus for transporting documents to and from a processing station having a platen, comprising:

a belt transport including a belt overlying the platen, adapted to move in a first direction to move a first document to the processing station, and in a second direction, opposed to the first direction, to move a second document from the processing station with a portion of the first document being in sliding contact with a portion of the second document and with both the first and second documents being interposed between said belt and the platen;

a variable pressure system for applying pressure to at least a portion of said belt directed toward the platen in an area where the first and second documents are interposed between said belt and the platen, said variable pressure system applies an increased pressure for feeding an entering document to a registered position at the processing station relative to a lower pressure exerted on the belt as an exiting document is ejected from the processing station; and a controller for actuating said variable pressure system to reduce the pressure being applied in said belt when said first and second documents are interposed in the area between said belt and the platen to facilitate documents traveling in opposite directions and sliding relative to one another.

2. An apparatus according to claim 1, wherein said variable pressure system exerts the lower pressure on said belt as the exiting document is ejected from the processing station so that the exiting document looses static contact with said belt and slides under said entering document and any portion of said belt remaining positioned thereover.

* * * * *